US009998833B2

(12) United States Patent
Wang et al.

(10) Patent No.: US 9,998,833 B2
(45) **Date of Patent: *Jun. 12, 2018**

(54) SPEAKER

(71) Applicant: AAC Technologies Pte. Ltd., Singapore (SG)

(72) Inventors: Hongxing Wang, Shenzhen (CN); Chengxia Ji, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/069,009

(22) Filed: Mar. 14, 2016

(65) Prior Publication Data

US 2017/0034631 A1 Feb. 2, 2017

(30) Foreign Application Priority Data

Jul. 31, 2015 (CN) ..... 2015 2 0573349 U

(51) Int. Cl.

| | |
|---|---|
| ***H04R 25/00*** | (2006.01) |
| ***H04R 9/04*** | (2006.01) |
| ***H04R 9/06*** | (2006.01) |
| *H04R 31/00* | (2006.01) |
| *H04R 9/02* | (2006.01) |

(52) U.S. Cl.

CPC ..... *H04R 9/045* (2013.01); *H04R 9/06* (2013.01); *H04R 9/025* (2013.01); *H04R 9/047* (2013.01); *H04R 31/006* (2013.01); *H04R 2499/11* (2013.01)

(58) Field of Classification Search

CPC .. H04R 2499/11; H04R 9/045; H04R 1/2811; H04R 31/006; H04R 7/18; H04R 9/046

USPC ..... 381/398, 400, 417, 418, 423, 431

See application file for complete search history.

(56) References Cited

U.S. PATENT DOCUMENTS

| | | | | |
|---|---|---|---|---|
| 5,701,358 | A * | 12/1997 | Larsen | H04R 9/063 381/400 |
| 6,285,773 | B1 * | 9/2001 | Carme | H04R 9/06 181/150 |
| 2005/0276431 | A1 * | 12/2005 | Moore | H04R 1/345 381/340 |
| 2009/0141926 | A1 * | 6/2009 | Clair | H04R 1/403 381/404 |
| 2010/0171376 | A1 * | 7/2010 | Huang | H02K 33/18 310/25 |
| 2012/0177246 | A1 * | 7/2012 | Shi | H01F 7/0289 381/398 |

(Continued)

*Primary Examiner* — Davetta W Goins
*Assistant Examiner* — Phylesha Dabney
(74) *Attorney, Agent, or Firm* — Na Xu; IPro, PLLC

(57) ABSTRACT

A speaker is provided in the present disclosure. The speaker includes a shell, a magnetic system received in the shell, and a vibrating system. The vibrating system includes a membrane and a coil assembly connecting to the membrane for driving the membrane to vibrate. The magnetic system is arranged at two opposite sides of the coil assembly; and the coil assembly is arranged perpendicular to the membrane. The coil assembly includes a coil and a coil support for supporting the coil, the coil support includes a main body and a first extending part extending from an edge of the main body, the coil is supported and fixed to the main body, and the first extending part is connected to the membrane.

16 Claims, 4 Drawing Sheets

(56) References Cited

U.S. PATENT DOCUMENTS

| | | | | |
|---|---|---|---|---|
| 2016/0157019 | A1* | 6/2016 | Tomas | H04R 9/025<br>381/400 |
| 2017/0034627 | A1* | 2/2017 | Mao | H04R 9/025 |
| 2017/0034629 | A1* | 2/2017 | Mao | H04R 9/045 |
| 2017/0034631 | A1* | 2/2017 | Wang | H04R 9/045 |

* cited by examiner

SPEAKER

FIELD OF THE DISCLOSURE

The present disclosure relates to electro-acoustic converting technologies, and more particularly, to a speaker for producing audible sound.

BACKGROUND

Speakers are widely applied in mobile devices, such as mobile phones, tablet computers, laptop computers, portable game player, portable multimedia devices, or the like, for converting electrical signals into audible sounds. A related speaker includes a vibration system, a magnetic system, and a holder for holding the vibration system and the magnetic system. The vibrating system includes a membrane and a coil assembly connected to the membrane for driving the membrane to vibrate and produce sound.

The coil assembly includes a coil and a coil support for supporting the coil, the coil support includes a first supporting part and a second supporting part opposite to each other to form a receiving gap, and the coil is arranged in the receiving gap. However, each of the first supporting part and the second supporting part does not exert any force to one another, which may cause an intensity of the coil support to be weak. Therefore, the coil support is apt to suffer distortion in operation, and an acoustic performance and a lifespan of the speaker is low.

Therefore, it is desired to provide a new speaker which can overcome the aforesaid problems.

BRIEF DESCRIPTION OF THE DRAWINGS

Many aspects of the embodiment can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and the embodiment thereof.

Figure 1:
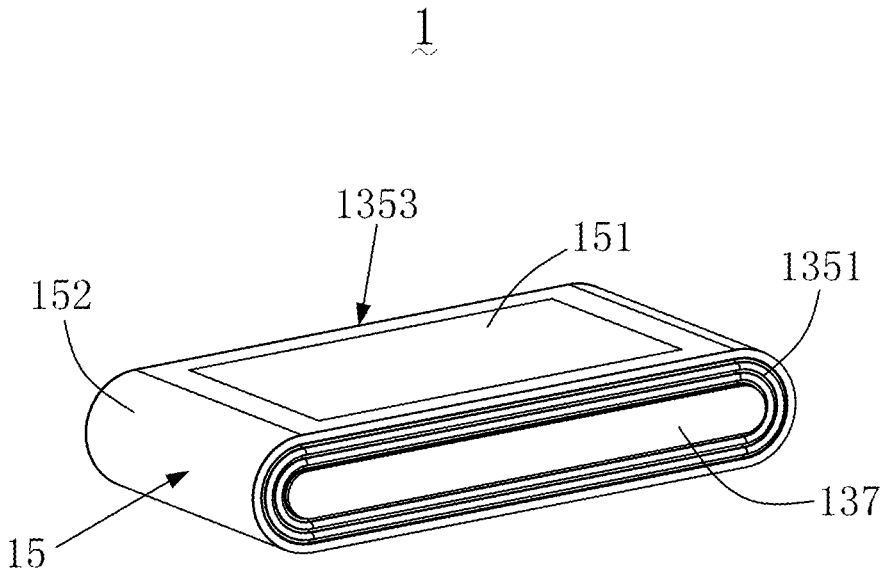
FIG. 1 is an assembled view of a speaker according to an embodiment of the present disclosure.
Figure 2:
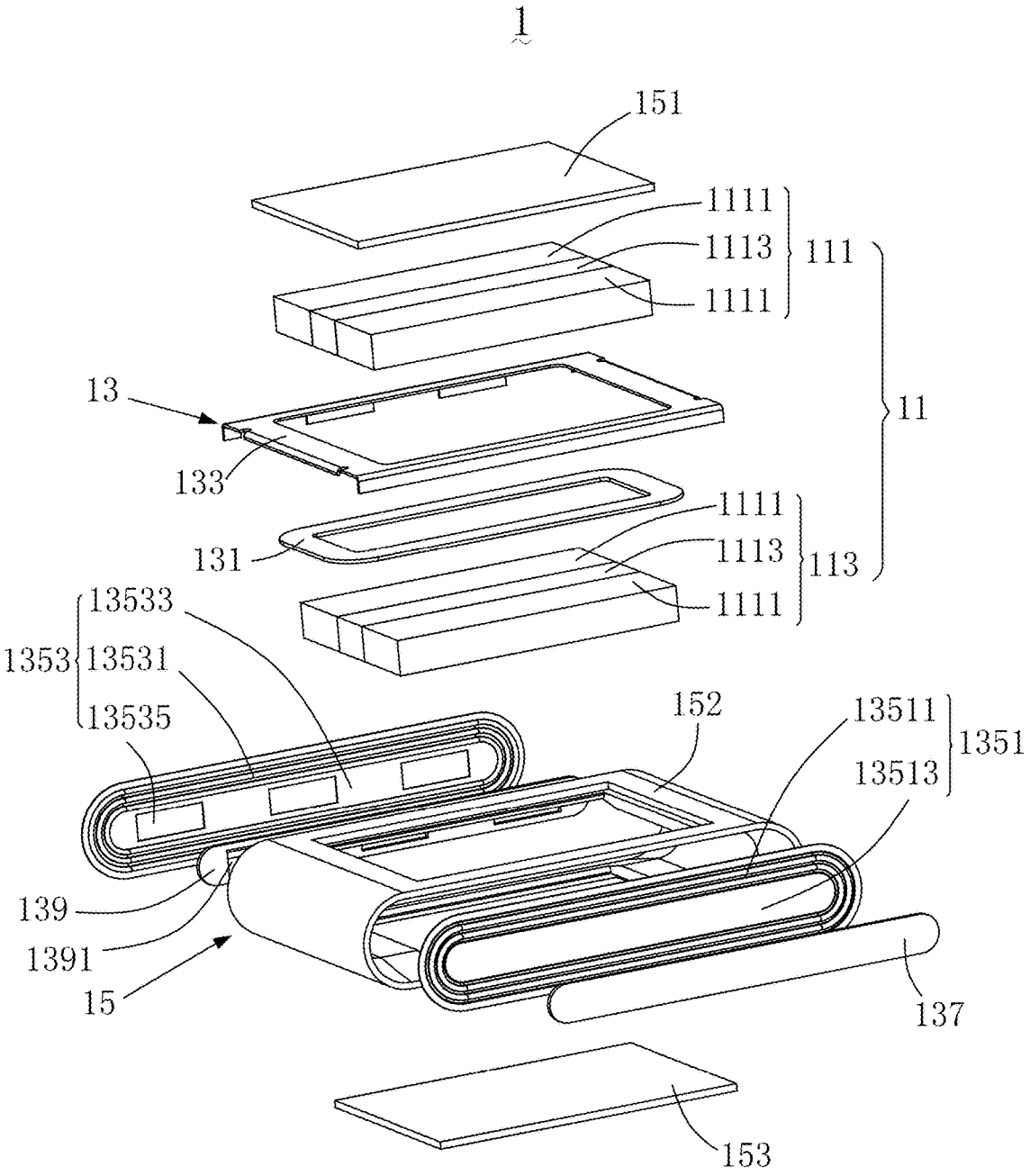
FIG. 2 is an exploded view of the speaker of FIG. 1.
Figure 3:
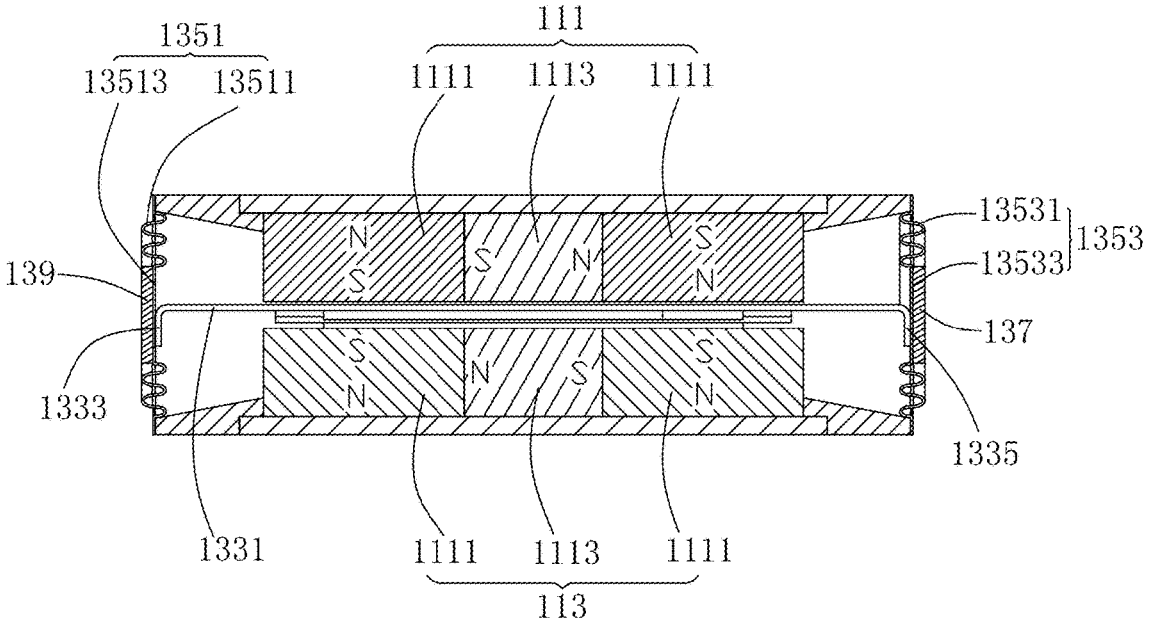
FIG. 3 is a cross-sectional view of the speaker of FIG. 1.

Referring to FIGS. 1-3, a speaker 1 according to an embodiment of the present disclosure is shown. The speaker 1 includes a magnetic system 11, a vibrating system 13 and a shell 15. The shell 15 provides an accommodating space; the vibrating system 13 and the magnetic system 11 are accommodated in the accommodating space.

Specifically, the shell 15 includes a main frame 152, a first cover plate 151 and a second cover plate 153. The main frame 152 is a hollow frame with two opposite openings; in the present embodiment, the two openings may be defined as a front opening located at a front end of the main frame 152, and a rear opening located at a rear end of the main frame 152. The front end is adjacent to a sound outlet of the speaker 1, and the rear end is away from the sound outlet of the speaker 1.

The main frame 152 further includes a top plate with a top opening and a bottom plate with a bottom opening; the top plate and the bottom plate are opposite to each other and perpendicular to opening directions of the front opening and the rear opening. The first cover plate 151 and the second cover plate 153 are respectively provided to cover the top opening and the bottom opening of the main frame 152. In the present embodiment, the first cover plate 151 and the second cover plate 153 are detachable from the main frame 152, which is convenient for assembly and disassembly of speaker components (including the vibrating system 13 and the magnetic system 15) inside the shell 11.

The magnetic system 11 includes a first magnet module 111 and a second magnet module 113 opposite to and apart from each other to form a magnetic gap. Each of the first magnet module 111 and the second magnet module 113 includes two main magnets 1111 parallel to each other and a secondary magnet 1113 arranged between the two main magnets 1111. The main magnets 1111 and the secondary magnet 1113 are all elongated magnets, and the secondary magnet 1113 is parallel to and abuts against the two main magnets 1111.

A magnetized direction of one of the main magnets 1111 is opposite to the other one of the main magnets 1111, and is perpendicular to a vibration direction of the vibrating system 13. A magnetized direction of the secondary magnet 1113 is parallel to the vibration direction of the vibrating system 13, and thus is also perpendicular to that of the main magnets 1111. With this configuration, the magnetic gap is formed between the main magnets 1111 of the first magnet module 111 and the main magnets 1111 of the second magnet module 113, and the magnetic system 11 can have a higher electromagnetic conversion efficiency, which can further improve a sound effect of the speaker 1.

It should be noted that the above description is merely one of optional configurations of the magnetic system 11, in other embodiments, for example, the first magnet module 111 may only include a single main magnet, and the second magnet module 153 may be removed or replaced by a magnetic-conductive component; alternatively, each of the first magnet module 111 and the second magnet module 113 may include a single main magnet.

The vibrating system 13 includes a coil 131, a coil support 133, a membrane 1351, a first dome 137, a supporting assembly 1353 and a second dome 139. The membrane 1351 and the supporting assembly 1353 are opposite to each other, and respectively arranged at the front opening and the rear opening of the main frame 152. The first dome 137 may serve as a front dome and is attached on the membrane 1351; the second dome 139 may serve as a rear dome and is attached on the supporting assembly 1353.

The coil 131 and the coil support 133 cooperatively form a coil assembly serving as a vibration driving module for driving the membrane 1351 to vibrate and produce audible sound. The coil assembly is located in the magnetic gap between the first magnet module 111 and the second magnet module 113, and is connected between the membrane 1351 and the supporting assembly 1353. Moreover, in the present embodiment, the magnetic system 11 is merely arranged at two opposite sides of the coil assembly; and the coil assembly is arranged in a plane perpendicular to the membrane 1351 and the supporting assembly 1353.

The coil 131 may be an oblate ring-shaped coil formed by a plurality of conductive wires, which is positioned in the magnetic gap of the magnetic system 11 to obtain a long stroke. The coil support 133 is configured for supporting and fixing the coil 131, and transferring motion of the coil 131 to the membrane 1351.

Figure 4:
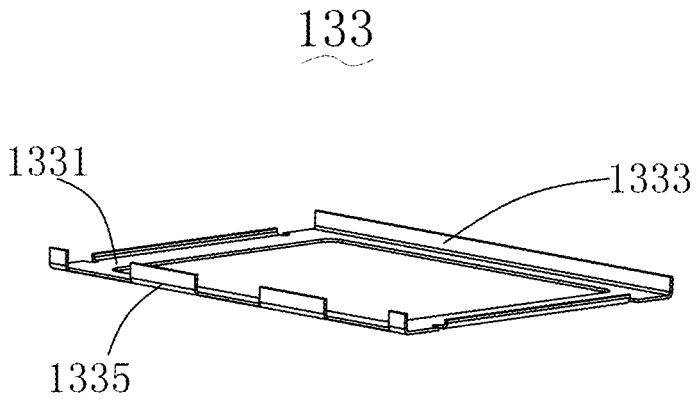
FIG. 4 is a schematic view of a coil support of the speaker of FIG. 1.

Referring also to FIG. 4, the coil support 133 includes a main body 1331, a first extending part 1333 and a second extending part 1335. The main body 1331 may be a rectangular ring-shaped plate with a first edge and a second edge opposite to each other, and the coil 131 is fixed on the main body 1331. The first extending part 1333 extends perpendicularly from the first edge of the main body 1331, and is connected to the membrane 1351. The second extending part 1335 extending perpendicularly from the second edge of the main body 1331, and is connected to the supporting assembly 1353.

In the present embodiment, the first extending part 1333 may be an elongated piece extending from the entire first edge of the main body 1331, and the second extending part 1335 may include a plurality of extending pieces apart from each other, as illustrated in FIG. 4. Moreover, the main body 1331, the first extending part 1333 and the second extending part 1335 may be integrated into a one-piece structure to enhance an intensity of the coil support 133 and protect the coil 131 thereon from suffering undesired distortion.

Furthermore, the coil support 133 may be made of material with light and rigid characteristics; for example, the coil support 133 may be made of aluminum alloy, which can improve an electro-acoustic converting efficiency of the speaker 1, and can also improve a rigidity of the coil support 133 to ensure stability of the coil 131. In other embodiments, the material of the coil support may alternatively be any one selected from magnesium alloy, stainless steel, plastic, and carbon fiber composite.

The membrane 1351 includes a first flat part 13513 located at a main central region thereof, and a first wrinkling part 13511 surrounding the first flat part 13513. The first wrinkling part 13511 has a wavy cross section, which enables the membrane 1351 to have a greater vibrating amplitude. The first extending part 1333 of the coil support 133 abuts against the first flat part 13513, and is located at a different side of the first flat part 13513 from the first dome 137. The first extending part 1333 can expand a contact area between the coil support 133 and the membrane 1351, and thus enhance a rigidity of the first flat part 13513 of the membrane 1351.

The supporting assembly 1353 may have a configuration similar to that of the membrane 1351, and is arranged substantially symmetrical with the membrane 1351 about the magnetic system 111. Specifically, the supporting assembly 1353 includes a second flat part 13533 located at a main central region thereof, and a second wrinkling part 13531 surrounding the second flat part 13533. The second extending part 1335 of the coil support 133 abuts against the second flat part 13533, and is located at a different side of the second flat part 13533 from the second dome 139.

Nevertheless, the supporting assembly 1353 differs from the membrane 1351 in that the second flat part 13533 includes a plurality of air holes 13535. The plurality of air holes 13535 may be arranged in a line, and are communicated with the accommodating space of the shell 111. The supporting assembly 1353 does not produce sound due to the air holes 13535, however, the supporting assembly 1353 can prevent the coil assembly and the membrane 1351 from suffering undesired swinging and increase K-value of the speaker 1, so that the speaker 1 can obtain a better sound effect as well as a longer lifespan.

The first dome 137 and the second dome 139 are respectively attached on the first flat part 13513 of the membrane 1351 and the second flat part 13533 of the supporting assembly 1353, and may have a shape and a size substantially same as the first flat part 13513 and the second flat part 13533 respectively. The first dome 137 and the second dome 139 can further enhance the intensity of the membrane 1351 and the supporting assembly 1353, and thereby improving the sound effect of the speaker 1.

The second dome 139 includes a plurality of through holes 1391 corresponding to the air holes 13531 of the supporting assembly 1353 respectively. The plurality of through holes 1391 may be aligned with the air holes 13531, and have a shape and a size substantially same as the air holes 13531.

In summary, the speaker 1 as provided in the present disclosure uses the coil support 133 with the above-described configuration, the coil support 133 has a greater intensity of the coil support 131, and thus can protect the coil 131 thereon from suffering undesired distortion. Therefore, an acoustic performance and a lifespan of the speaker 1 can be improved.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a shell;

a magnetic system received in the shell; and a vibrating system comprising a membrane and a coil assembly connecting to the membrane for driving the membrane to vibrate;

wherein the magnetic system is arranged at two opposite sides of the coil assembly; the coil assembly is arranged in a plane perpendicular to the membrane, and comprises a coil and a coil support for supporting the coil, the coil support comprises a main body, a first extending part extending from an edge of the main body and a second extending part extending from an opposite edge of the main body, the coil is supported and fixed to the main body, and the first extending part is connected to the membrane, the main body, the first extending part and the second extending part of the coil assembly are integrated into a one-piece structure.

2. The speaker of claim 1, wherein the membrane comprises a first flat part and a first wrinkling part surrounding the first flat part, and the first extending part of the coil support abuts against the first flat part of the membrane.

3. The speaker of claim 2, wherein the vibrating system further comprises a first dome, the first dome is attached on the first flat part of the membrane, and is arranged at a different side of the first flat part from the first extending part of the coil support.

4. The speaker of claim 1, wherein the vibrating system further comprises a supporting assembly opposite to the membrane, and the second extending part of the coil support is connected to the supporting assembly.

5. The speaker of claim 4, wherein the supporting assembly comprises a second flat part and a second wrinkling part surrounding the second flat part, the second extending part of the coil support abuts against the second flat part of the supporting assembly.

6. The speaker of claim 5, wherein the supporting assembly further comprises a plurality of air holes formed at the second flat part, the air holes are communicated with an accommodating space provided by the shell.

7. The speaker of claim 6, wherein the vibrating system further comprises a second dome, the second dome is attached on the second flat part of the supporting assembly and is arranged at a different side of the second flat part from the second extending part of the coil support.

8. The speaker of claim 7, wherein the second dome further comprises a plurality of through holes aligned with the air holes of the supporting assembly.

9. The speaker of claim 1, wherein material of the coil support is selected from aluminum alloy, magnesium alloy, stainless steel, plastic, and carbon fiber composite.

10. The speaker of claim 1, wherein the main body of the coil assembly is a rectangular ring-shaped plate.

11. The speaker of claim 1, wherein the shell comprises a main frame for receiving the vibrating system and the magnetic system, the main frame is a hollow frame with a front opening and a rear opening; the membrane and the supporting assembly are respectively arranged at the front opening and the rear opening.

12. The speaker of claim 11, wherein the main frame comprises a top plate with a top opening and a bottom plate with a bottom opening, and the shell further comprises a top cover plate covering the top opening and a bottom cover plate covering the bottom opening.

13. The speaker of claim 12, wherein the first cover plate and the second cover plate are detachable from the main frame.

14. The speaker of claim 1, wherein the magnetic system comprises a first magnet module and a second magnet module opposite to and apart from each other for forming a magnetic gap, and the coil assembly is received in the magnetic gap.

15. The speaker of claim 14, wherein each of the first magnet module and the second magnet module comprises two main magnets parallel to each other and a secondary magnet arranged between the two main magnets.

16. The speaker of claim 15, wherein a magnetized direction of one of the two main magnets is opposite to the other one of the two main magnets, and is perpendicular to a vibration direction of the vibrating system; a magnetized direction of the secondary magnet is parallel to the vibration direction of the vibrating system.

* * * * *